United States Patent [19]

Ando et al.

[11] 4,389,738

[45] Jun. 28, 1983

[54] BODY PART CLEANSING DEVICE

[75] Inventors: Shizuka Ando; Hiroshi Oyama; Toshio Yamaguchi, all of Kitakyushu, Japan

[73] Assignee: Toto, Ltd., Fukuoka, Japan

[21] Appl. No.: 244,668

[22] Filed: Mar. 17, 1981

[51] Int. Cl.[3] ..... A47K 4/00; A47K 3/20

[52] U.S. Cl. ..... 4/420.2; 4/420.4; 4/420.5; 4/443; 4/447

[58] Field of Search ..... 4/443, 444, 445, 446, 4/447, 448, 420.1, 420.2, 420.3, 420.4, 420.5, 542

[56] References Cited

U.S. PATENT DOCUMENTS

| | | | |
|---|---|---|---|
| 1,982,259 | 11/1934 | Martin | 4/542 |
| 2,872,687 | 2/1959 | Maurer | 4/420.2 |
| 3,247,524 | 4/1966 | Umann | 4/447 X |
| 3,995,326 | 12/1976 | Umann | 4/447 X |
| 4,028,745 | 6/1977 | Caniglia | 4/420.2 |
| 4,123,807 | 11/1978 | Oguma et al. | 4/448 |
| 4,208,746 | 6/1980 | Minamoto et al. | 4/448 |
| 4,237,560 | 12/1980 | Riegelmann et al. | 4/447 |
| 4,262,371 | 4/1981 | Berry et al. | 4/542 |
| 4,304,016 | 12/1981 | Oguma et al. | 4/448 X |
| 4,320,541 | 3/1982 | Neenan | 4/542 |

*Primary Examiner*—Henry K. Artis

*Attorney, Agent, or Firm*—Sandler & Greenblum

[57] ABSTRACT

A body part cleansing device for use with a toilet is provided. The device provides a jet of warm water which has been mixed with air to a desired body part of a user in order to cleanse the body part. The device includes a cleaning nozzle adapted to direct a jet of warm water in combination with air and includes a nozzle member, an injector member and a joint which are separably interconnected and which can be easily assembled and disassembled. By being so connected, the two members and the joint are satisfactorily aligned to provided a desired angle and direction of water jet for effective cleansing purposes. Air is mixed with water within the nozzle member, air being introduced in the nozzle member via an air intake unit which mixes air with heated water prior to the warm water jet exiting from a jet opening in the nozzle member. Optionally, an auxiliary nozzle unit can be provided which includes a nozzle member and a jet opening directed towards the rear of the toilet in order to clean the back portion thereof. Both the cleansing nozzle and the auxiliary nozzle unit are enclosed within a nozzle cover in order to prevent either the cleansing nozzle or the auxiliary nozzle unit from being subjected to an unhygienic environment.

15 Claims, 9 Drawing Figures

BODY PART CLEANSING DEVICE

BACKGROUND OF THE INVENTION

1. Technical Field of the Invention

The present invention generally relates to a body part cleansing device for cleansing an area of a user's body, e.g., the anus, after the user has utilized a toilet, and more particularly a body part cleansing device including apparatus for jetting warm water to a predetermined body portion.

2. Discussion of Prior Art

It is generally accepted that the desirable temperature of warm water jetted from a cleansing nozzle of a conventional body part cleansing device, e.g. a device which is used to cleanse parts of a user's body such as the anus and which is mounted ajdacent to the stool seat of a toilet bowl, is 30° C. to 40° C. and the water volume used is approximately 450–500 cc/minute.

However, tap water temperature often falls to as low as 0° C. to 10° C. during the winter, and in order to increase water temperature to the above-referred to desired level, a heating unit is required for the water which consumes more than 1 kW. of power. Such a unit is not, however, suitable as an electrical appliance for installation in average houses. If such an appliance is installed in an ordinary house, special electric wiring and the fitting of a special electrical receptacle are generally required.

Therefore, a conventional body part cleansing device of the type disclosed above must in some manner preserve heat or otherwise reduce the power consumed to a level below 1 kW., in order that such a device will be more readily acceptable by consumers as a household electric appliance.

Generally, the factors which are considered in determining the cleansing effect of a body part cleansing device of the above-identified type include the following:

(a) the temperature of jetted water;
(b) the angle of jetted water;
(c) the speed of jetted water; and
(d) the volume of water utilized.

With respect to water temperature, it is generally recognized that the higher the temperature of the water used, the better the cleansing effect. However, water over 40° C. is generally considered to be too hot, and, therefore, a range of water temperature between 36° C. and 40° C. is generally considered to be appropriate. The preferable or recommended angle of jetted water is considered to be approximately 30°, the angle directed upwardly from the rear towards the front of the toilet seat, which is particularly important with respect to the mounting position of the water nozzle and the splashing of cleansing water which may occur. With respect to the speed of the jetted water, it is generally considered that the faster the speed, the greater the cleansing effect. However, there is an upper limit on the speed of the water, which is established with respect to the pain felt by a user along the part of the body being cleansed when the speed is too fast; furthermore, when the speed of water is too great, an undesirably large splash about the periphery of the toilet will occur. With respect to the volume of water used, it is generally considered that the cleansing effect of the device increases with the use of greater volumes of water. However, the volume of water must necessarily be limited to a maximum level established and determined by the capacity of the water supply system installed in houses in which the device is used. The volume of water required will also be a factor in determining the amount of energy required to raise the water to a desired temperature.

Taking all of these factors into consideration, a preferred cleansing device comprises a jet nozzle having an inner diameter of approximately 1.5 mm. which jets water therefrom so that a consumption of 450–500 cc/min. results.

A body part cleansing device having such features is generally disclosed by U.S. Pat. No. 3,247,524.

The cleansing device disclosed by such patent, however, is disadvantageous in that it requires the installation of a warm water tank and other facilities for heat preservation. Additionally, the device is quite large, the heating mechanism complicated, and additional electric power must be supplied to generate sufficient heat to compensate for heat dissipation from the warm water tank under circumstances in which the cleansing device is not utilized for a long period of time.

Furthermore, the device disclosed in the patent includes a nozzle which is exposed within the toilet bowl in which it is placed and which is therefore easily splashed with urine when the toilet is used, resulting in an unclean and unhygienic cleansing device.

Another body part cleansing device is disclosed in U.S. Pat. No. 2,872,687. This device attempts to overcome the unhygienic conditons referred to above by providng a contractible nozzle member which can be reduced in length when the device is not in use so that urine will not be splashed thereon.

This device, however, is disadvantageous in that it incorporates a complicated mechanism to achieve cleanliness and because the manufacturing costs of providing such a mechanism are inevitably high.

Further, the device disclosed by U.S. Pat. No. 3,247,524, referred to above, is constructed so that its injector unit is formed integrally with the joint which connects the spray nozzle member to the warm water supply pipe; this results in manufacturing difficulty in forming the joint and in boring the throttle hole of the injector; this construction also and causes relatively imprecise installation, and thereby undesirable results and performance, of the device.

A third cleansing device is disclosed in U.S. Pat. No. 3,995,326. This device incorporates an independent injector member and nozzle member which are mounted separably at a fixed distance from one another.

Such a fixed distance between the injector unit and nozzle member when mounted causes a very critical problem in assembly and adjustment of the aligned or mating parts. As seen in FIGS. 8 and 9, a relative deflection of up to 0.5 mm. of the injector unit and the nozzle member, as taken in the lateral direction, will cause a resultant deflection in the jetted water spray of approximately 1 mm. from a desired cleansing point. Even if a 5 mm. maximum deflection from a desired cleansing point is permitted, the deflection of the injector unit in the lateral direction must be maintained at 0.7 mm. or less. As seen from the graph in FIG. 9, the allowable deflection in the longitudinal direction of the unit influences the angle of the water jet coming from the nozzle, and this must be maintained at backward deflection 0.3 mm. and at forward deflection 0.7 mm. or less. Otherwise, the water jet angle will be reduced to less than 20°; such a reduced water jet angle will nullify the cleansing purposes of the present device, as illustrated in FIG. 9. The usable zones illustrated in the graphs in FIGS. 8 and 9 represent the areas in which the water jet achieves its desired cleaning purposes. These graphs point up the fact that the mating or alignment of the nozzle and injector member is critical and can be very troublesome if outside of a rather limited range. Conventional parts mating procedures can lead to many difficulties, particularly because even a slight misalignment between the parts can cause a device to be unable to properly cleanse a predetermined body area.

SUMMARY OF THE INVENTION

The present invention is intended to overcome the above disadvantages, and is based upon the findings of the inventors that the desired cleansing effect can be obtained, even when using a relatively small volume of cleasing water, by mixing air in the form of bubbles with the warm water for cleansing purposes. These findings have been established through a variety of research procedures and studies that have been carried out by the present inventors.

Accordingly, a first object of the present invention is to obtain a body part cleansing device which can reduce the power consumption of a heating device to 1 kW. or less without decreasing the cleansing effect of the device and without necessitating the use of heat preservation means.

In accordance with the present invention, the above-object can be achieved by a body part cleansing device which incorporates the features described more particularly hereinafter, i.e., a device having an air intake unit for supplying air and for mixing air with warm water fed from a heating device, the air intake unit being mounted on the nozzle which jets cleansing water to a predetermined body portion of a user.

Another object of the present invention is to provide a body part cleansing device which prevents or minimizes undesirable deflection of cleansing water in the lateral direction at a predetermined cleansing point, as well as prevents or minimizes undesirable deflection of the jet water angle at a predetermined point. These objects are achieved by the structure as described more particularly hereinafter.

Yet another object of the present invention is to provide a new and improved body part cleansing device in which a joint or connecting member, a nozzle member, and an injector member, all of which together comprise the nozzle of the device, are constructed so that they can be freely and easily connected to or separated from one another, in order to insure facilitated joint and injector throttle bore manufacture and precision in manufacture of the detachably secured elements of the structure.

Yet another object of the present invention is to provide a new and improved body part cleansing device used in cooperation with a toilet and which includes a nozzle which canot be directly splashed with urine. This object is accomplished by using a simplified construction which can be achieved at a relatively low manufacturing cost.

The above and other objects, purposes and advantages of the present invention can be provided for in one aspect thereof by a body part cleansing device which is adapted to be used with a toilet and which comprises a nozzle having means for directing a jet of warm water for cleaning to a predetermined part of a user's body. The device also comprises an air intake unit which introduces air into the nozzle. The nozzle is adapted to mix the air with heated water prior to the jet being directed to the predetermined body part.

Upon further study of the specification and appended claims, other objects, features and advantages of the present invention will become more fully apparent to those skilled in the art to which this invention pertains.

BRIEF DESCRIPTION OF THE DRAWINGS

The above and other objects, features and advantages of the present invention will become more fully apparent to those of ordinary skill in the art to which this invention pertains from the following detailed description, when considered in connection with the accompanying drawings, in which like reference characters designate like or corresponding parts throughout the several views, and wherein.

DETAILED DESCRIPTION OF THE DRAWINGS

Figure 1:
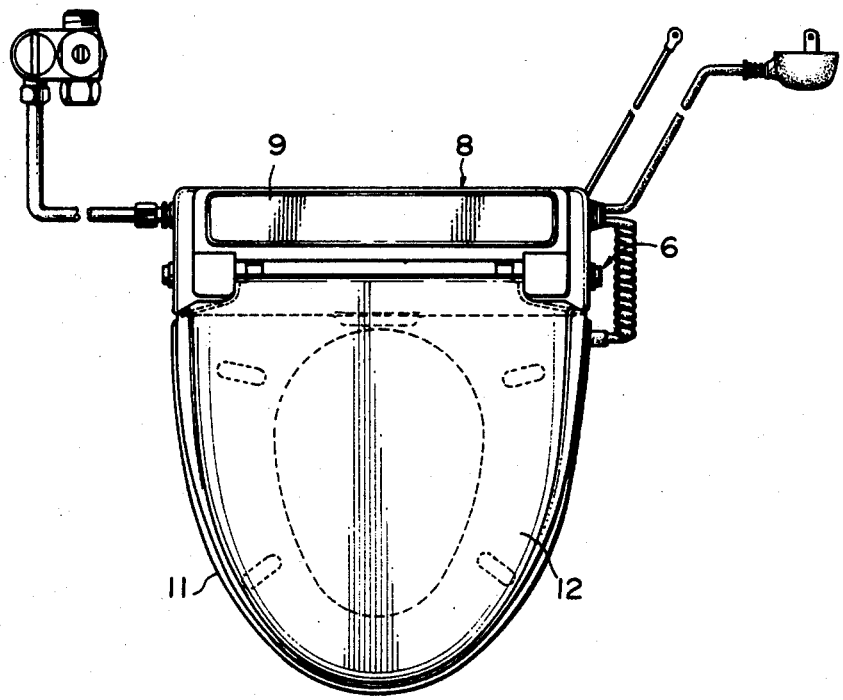
FIG. 1 is a plan view of a toilet seat provided with a body part cleansing device in accordance with the present invention.

The invention will hereinafter be more fully described with respect to the attached drawings.

As shown in the FIGS., the body part cleansing device includes an electromagnetic valve 1, a flow adjustment valve 2, a heating device 3, and a cleansing nozzle 4. All of these elements are interconnected and comprise, together with the appropriate tubing, a main water supply line (a) for connecting a water supply source (not shown), e.g., a source of tap water, with cleansing nozzle 4. The main water supply line has a branch in the form of auxilary water supply line (b) which extends from a second side of flow adjustment valve 2.

The main and auxiliary water supply lines, together with temperature controlling device 5, comprise the major functioning unit (A) of the present device. Temperature controller 5 controls the temperature of cleansing water at a predetermined level and is electrically connected to the heater of heating device 3, which is included in main water supply line (a). The functioning unit also includes operation switch 6, which controls the on and off functioning of the electric circuit for electromagnetic valve 1.

Functioning unit (A) begins operation when switch 6 is operated and electromagnetic valve 1 is thereby supplied with power. When valve 1 is actuated, part of the water supplied from the source is then free to flow through flow adjustment valve 2, auxiliary water supply line (b) and auxiliary nozzle 7. This water is eventually jetted from auxiliary nozzle 7. The remaining water passes through flow adjustment valve 2 and heating device 3 so that it will be heated to an appropriate temperature, finally being jetted from cleansing nozzle 4.

Functioning unit (A) is arranged and accommodated within enclosing case 8.

Figure 2:
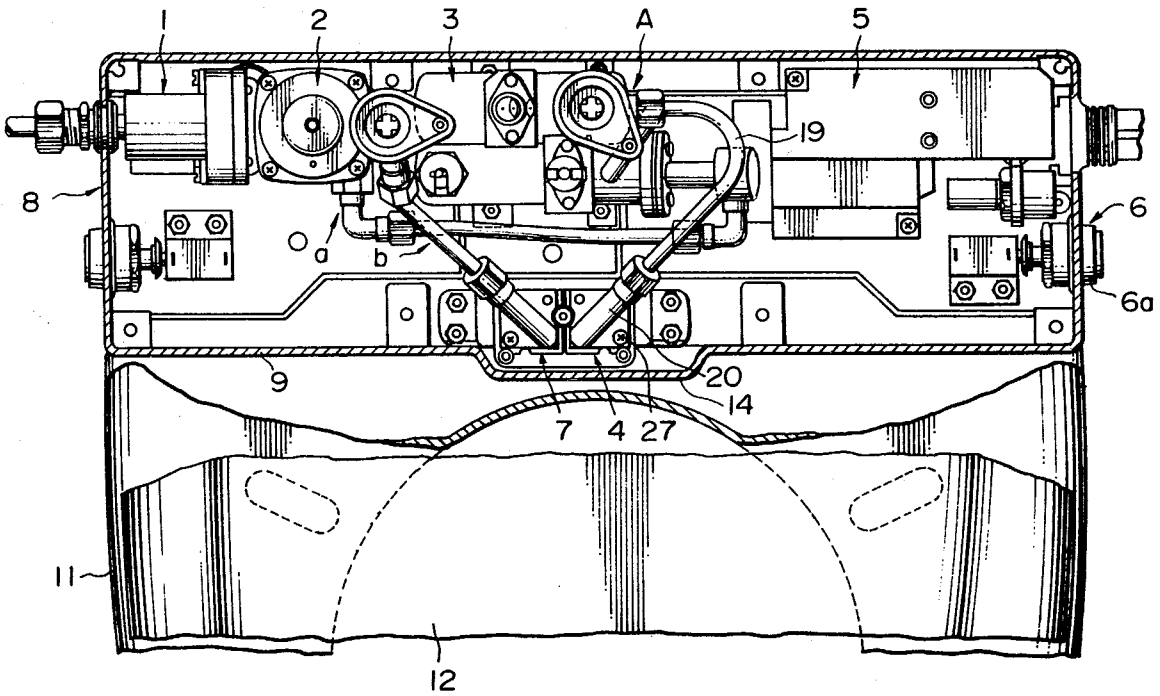
FIG. 2 is a partially cut away cross-sectional view of a body part cleansing device within an enclosing case.
Figure 3:
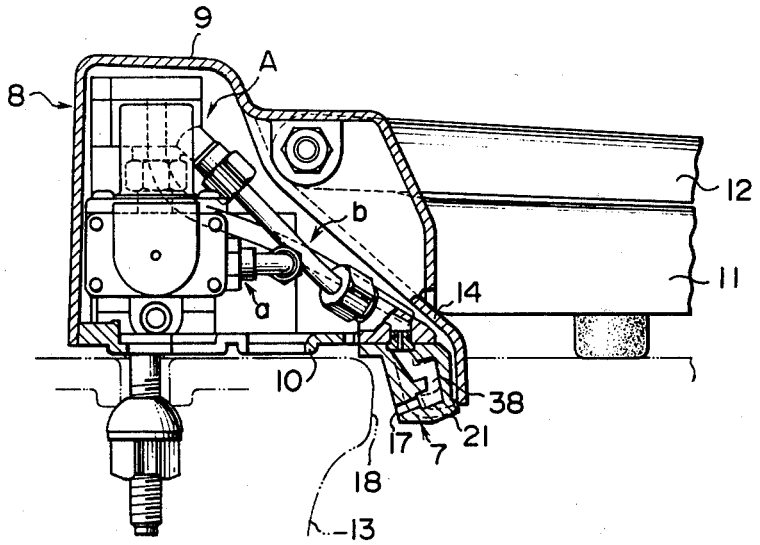
FIG. 3 is a partially cut away side view of the enclosing case of FIG. 2.

The enclosing case comprises a generally box-like cover 9 having a bottom opening; a bottom plate 10, as seen in FIG. 3, is provided for covering the bottom opening. Additionally, seat 11 and lid 12 are provided in front of the enclosing case 8 in a fashion so that they can be both opened and closed with ease. The enclosing case is constructed so that it can be mounted on the rear upper portion of toilet 13. Seat 11 is positioned about the upper part of the rim which surrounds the toilet bowl. The majority of elements of the functioning unit (A) are mounted on bottom plate 10. A notable exception is the operable portion 6*a* of operation switch 6, which is mounted on cover 9, as is illustrated in FIG. 2.

Cover 9 of case 8 includes a protruding portion which extends from the front lower side towards the center of cover 9. This protruding portion includes nozzle cover 14, as illustrated in FIG. 3, and extends downwardly below the level of bottom plate 10. The nozzle cover is provided with a small window 15 along a lower portion thereof; this window permits jetted water to be directed through the nozzle cover.

Figure 4:
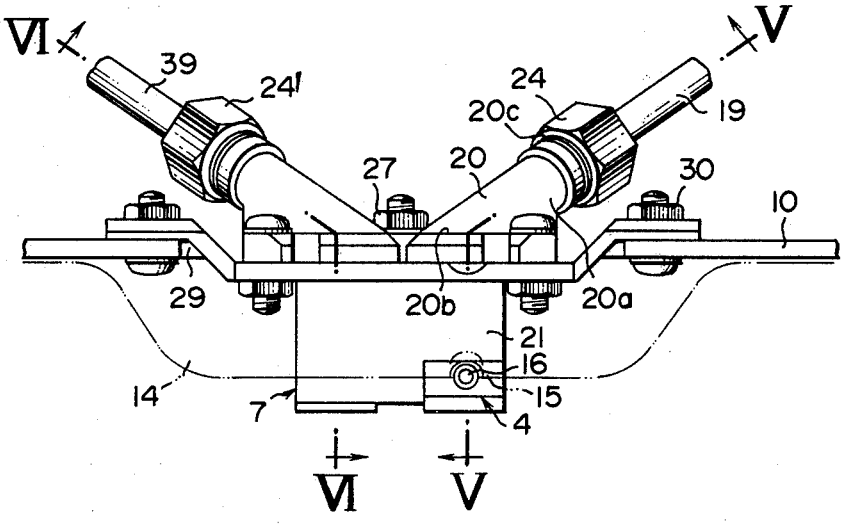
FIG. 4 is an enlarged front view of nozzles which form a part of the cleansing device of FIG. 1.
Figure 5:
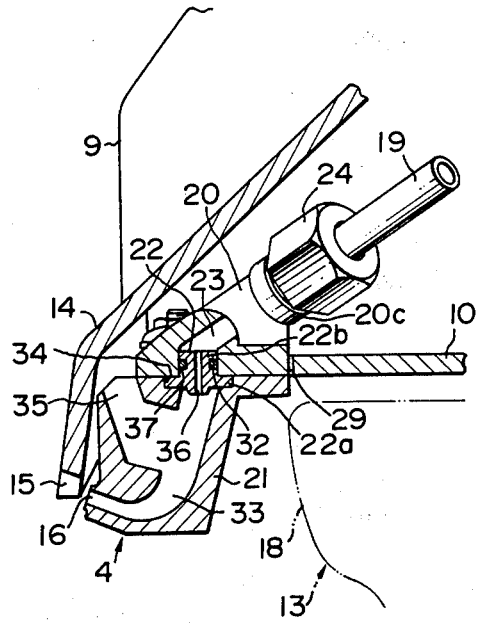
FIG. 5 is a sectional view taken along lines V—V of FIG. 4.
Figure 6:
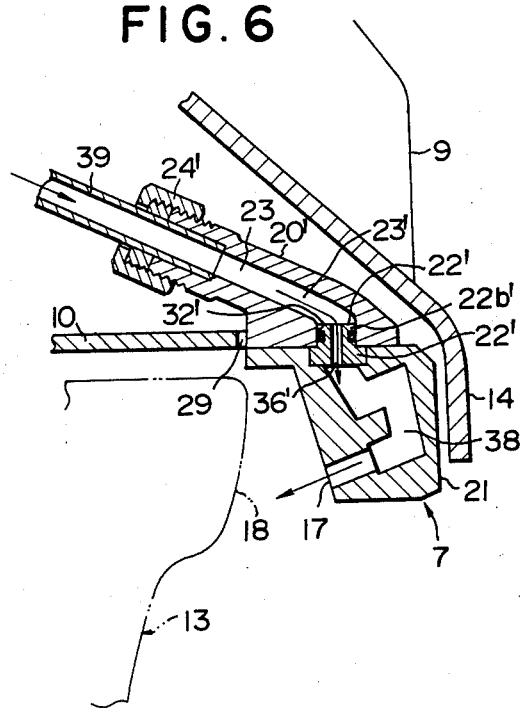
FIG. 6 is a sectional view taken along lines VI—VI of FIG. 4.

Cleansing nozzle 4 and auxiliary nozzle 7 are situated behind the nozzle cover 14, as illustrated in FIGS. 4–6.

The cleansing and auxiliary nozzles are situated in parallel along the central front edge of the bottom plate so that a major portion of the front side of the nozzles will be covered by nozzle cover 14. This arrangement is achieved by placing the nozzles in a slightly lower position than bottom plate 10. Jet opening 16 of cleansing nozzle 4 is provided at an upwardly directed mounting angle which is suitable for directing a water jet to a predetermined body portion of a user sitting on toilet seat 11 through window 15 of nozzle cover 14. Jet opening 17 of auxiliary nozzle 7, on the other hand, is directed backwardly towards rim 18 of stool 13. This is illustrated in FIG. 3.

Such an arrangmeent prevents nozzles 4 and 7 from being splashed with urine without requiring the incorporation of conventional and complicated systems, e.g., contractible nozzles. At the same time, the desired cleaning effect is maintained and hygienic use ensured, together with a reduction in manufacturing costs and difficulties. Furthermore, the nozzles and the surrounding structure are generally hidden and are difficult for a user to see. This results in a functional design which does not havy an undesirable shape, style or any aesthetic disadvantages. In other words, any shape or style nozzle can be utilized, based solely on the structure and function desired, as these nozzles will be hidden and will therefore not provide a displeasing appearance to a user.

Cleansing nozzle 4 comprises nozzle member 21, which is connected via joint 20 to warm water supply pipe 19. Supply pipe 19 feeds warm water from heating device 3. The nozzle also includes the joint 20 and injector member 22, which is located between nozzle member 21 and joint 20. This is illustrated in FIG. 5.

Figure 7:
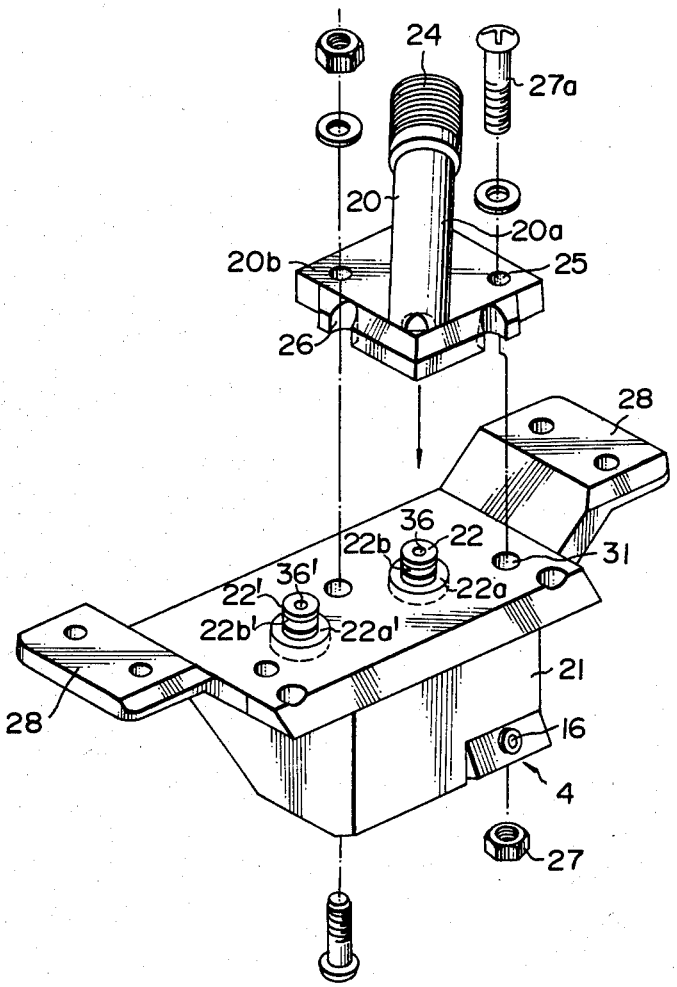
FIG. 7 is a perspective view of a disassembled nozzle.
Figure 8:
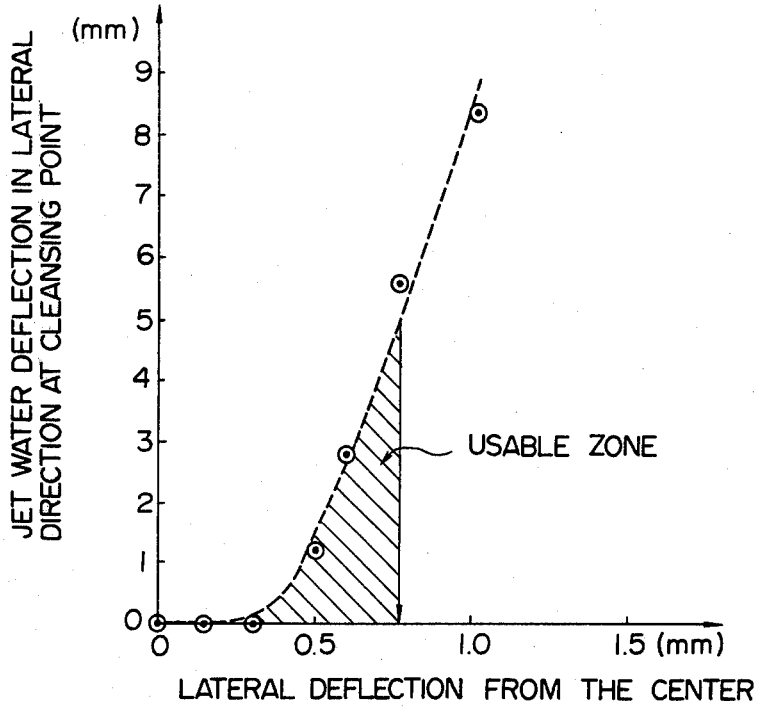
FIG. 8 is a graph illustrating the relationship between the lateral deflection of an injector member and a nozzle member from their respective centers and the resultant deflection of a water jet from a predetermined cleansing point, as taken in the lateral direction.
Figure 9:
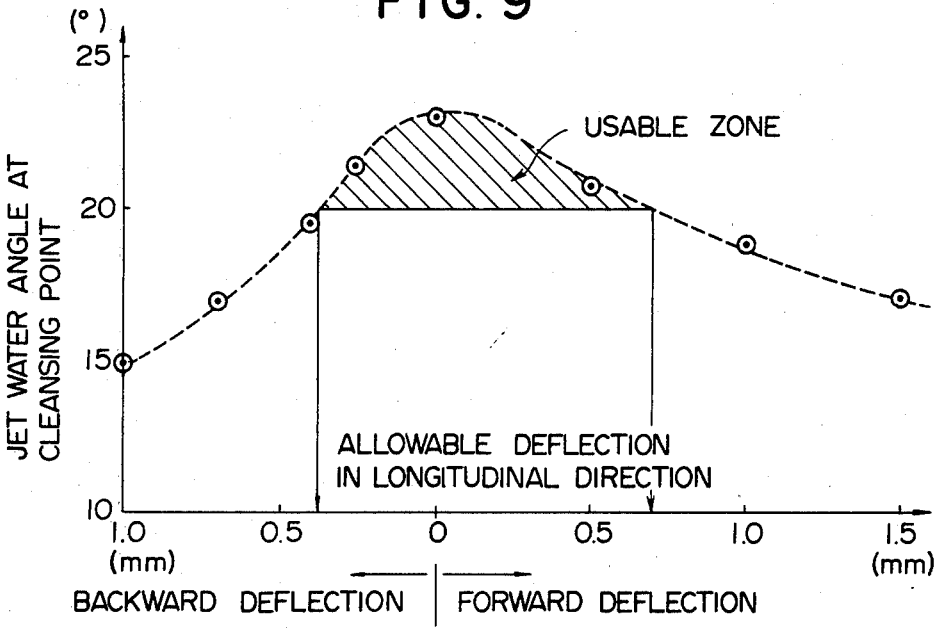
FIG. 9 is a graph illustrating the relationship between the longitudinal deflection of the injector and nozzle members, taken along the longitudinal direction, and the angle of the water jet at a predetermined cleansing point.

Joint 20 comprises tubular joint body 20*a* including axial through hole or bore 23. The joint also includes a flange-shaped clamp plate 20*b* integrally attached to a lower portion of tubular joint body 20*a*; the tubular joint body is connected, in turn, to the warm water supply line 19 via box nut 24, which is applied to threaded portion 20*c* located at the upper edge of joint body 20*a*. This is illustrated in FIG. 7. Additionally, clamp plate 20*b* is provided with clamping hole 25 and clamping cutout 26, through which plate 20*b* is clamped by means of bolt 27*a* and nut 27. This arrangement facilitates assembly and disassembly of nozzle 21 and joint 20.

As described hereinabove, cleansing nozzle 4 includes joint 20, nozzle member 21 and injector member 22. Nozzle member 21 has a generally T-shaped configuration, as illustrated in FIG. 7, and is mounted to the upper surface of the periphery of holder base 27. The holder base is formed by a cut in the front edge of bottom plate 10 of case 8. The nozzle member and holer base are affixed via a bolt and nut 30, or via a similar fastening device which securely attaches holder plates 28 protruding over the edges of the nozzle member 21 and the holder base 29. This is illustrated in FIG. 4, in which nozzle member 21 hangs downwardly from bottom plate 10 or protrudes downwardly from the back portion of the bottom plate.

Nozzle member 21 also includes through hole or clamping hole 31 through which bolt 27*a* is inserted and nut 27 applied in order to tighten the nozzle member 21 and joint 20. Nozzle member 21 includes guide passage 33, as illustrated in FIG. 5, which extends from the upper face of member 21, from outlet 32 of the through hole of joint 20, to the front face of member 21. The opening of guide passage 33 in the front face of nozzle member 21 comprises jet opening 16. This opening has a diameter of approximately 2 to 2.5 mm. and is directed at an oblique angle upwardly. The opening on the upper side of member 21 forms a recess 34 which has a diameter slightly larger than the diameter of guide passage 33.

Additionally, nozzle member 21 includes an air intake passage 35 bored within member 21 and which reaches or intersects an intermediate portion of guide passage 33, as seen in FIG. 5.

Injector member 22 comprises a tubular portion provided with a throttle hole 36 having a diameter of approximately 1 mm. in its axial direction. The injector member can be divided into two portions, i.e., large diameter portion 22*a* and small diameter portion 22*b* . Between these two portions a step is positioned as an intermediate axial portion of the member. Small diameter portion 22*b* has the same diameter as outlet 32 of joint hole 23. Large diameter portion 22*a* has aproximately the same diameter and length as does nozzle member recess 34. Packing member 37 is provided along the outer periphery of small diameter portion 22*b* of injector member 22. The small diameter portion is fitted to outlet 32 of joint hole 23 and large diameter portion 22*a* is fitted to recess 34 at the entrance of nozzle member guide passage 33. This facilitates assembly and disassembly of the injector member and joint. In this fashion, injector member 22 is maintained in a position between joint 20 and nozzle member 21.

Accordingly, the three portions of the nozzle, i.e., nozzle member 21, injector member 22, and joint 20, are mutually and detachably interconnected and fit together. In this fashion, connection and disconnection of the parts comprising the nozzle is relatively easy.

Such a construction permits easier manufacture of the joint and boring of the throttle hole than in the situation in which a solidly formed integral or single injector member and joint are manufactured. Additionally, the precision of boring the throttle hole is greatly improved in comparison to manufacture of an integral combined part.

When it is desired or required to alter the diameter of the throttle hole, it is only necessary to change the injector member, and it is not necessary to replace the joint. This contributes to decreased manufacturing costs and facilitates construction.

The described construction of the connection of injector member 22 and nozzle member 21 does not require adjustment of the mating positions of these members. This has previously been a necessity when using conventional cleansing devices of this type, in which the injector and nozzle members require separate mountings. The installation work involved in the present device is accordingly much simpler and requires no alignment. Further, the present construction of the fitting connection between the members greatly reduces the possibility of misalignment of the members due to loosening or wear of the members, e.g., as a result of frequent use, and provides cleansing water which is always jetted towards the correct portion of a user's body.

Auxiliary nozzle 7 is provided for cleansing the rim of toilet or stool 13. This nozzle comprises joint 20', injector member 22', and turn passage 38 bored within nozzle member 21. The nozzle member leads to jet opening 17, which represents the outlet of turn passage 38 and faces backwardly toward the rear portion of the stool rim.

Joint member 20' is constructed in generally identical fashion to joint 20 of cleansing nozzle 4, and has an upper portion connected to water supply pipe 39, which in turn leads to a second side of flow adjustment valve 2 via box nut 24'. As illustrated in FIG. 6, outlet 32' of through hole or bore 23' of the joint is fitted to injector member 22' to facilitate mounting and removal of member 22' from the nozzle structure. Member 22' includes a throttle hole 26' having a different diameter than that of the throttle hole of injector member 22. The outer diameter of small diameter section **22*b'* is the same as the diameter of small diameter section 22*b* of the injector member of cleansing nozzle 4**.

Turn passage 38 is directly fluidically connected with throttle hole 36' and is provided in nozzle member 21 in a generally parallel arrangement with guide passage 33 of cleansing nozzle 4.

The auxiliary nozzle includes the same or similar connecting construction for joint 20', injector member 22', and nozzle member 21', as are utilized in cleansing nozzle 4.

As set forth above, the diameters of throttle holes 36 and 36' differ, but the diameters of sections **22*b* and 22*b'* are the same. Accordingly, joints 20 and 20'** can be interchangably utilized for either the cleansing or auxiliary nozzle construction.

It is not necessary that the auxiliary water supply line (b) and auxiliary nozzle 7 be utilized. These are only provided for cleaning a portion of the bowl and not for directing cleansing liquid to a predetermined body portion of a user. In operation, water is supplied from the unillustrated supply source and directed through electromagnetic valve 1 and flow adjustment valve 2. Thereafter, it is warmed to an appropriate temperature in heating device 3, from which the heated water utilized for cleansing purposes is directed through throttle hole 36 of injector member 22 and along guide passage 33 of nozzle member 21. Guide passage 33 forces warm water to turn about approximately 120° within the passage in the direction of flow until the warm water is eventually jetted outwardly from jet opening 16 towards the predetermined body portion. Air intake passage 35, provided as part of nozzle member 21, directs or introduces air to an approximately intermediate portion of guide passage 33 to permit the heated or warmed water to draw in sufficient air through the passage and result in warm water which is mixed with air bubbles which is thereafter jetted outwardly from jet opening 16.

The diameter of jet opening 16 is slightly larger than the openings of previous cleansing devices of this general type. Accordingly, a moderate water jet speed is obtained and the volume of water utilized is generally smaller than that of previous devices while obtaining a generally greater cleansing effect because air bubbles are included within the jetted water.

Since the jetted water includes air bubbles, a user experiences a generally softer sensation and will not feel any pain on or around the part of the body being cleansed. Simultaneously, the water will not become splashed about the periphery of the toilet bowl to the same degree as has been previously experienced.

In accordance with the results of conducted experiments, utilization of water of a volume of 350 to 400 cc./min. and a water temperature of approximately 36° to 40° C. produces the same cleansing effect as obtained by the use of conventional cleansing devices of this type which utilize 450 to 500 cc./min. of water.

Accordingly, the water consumption required is only 350 to 400 cc./min. because air is drawn and mixed with the cleansing warm water. The reduced volume of water can therefore be heated by a heating device of 1 kW. capacity or less without the need for installing any additional heat preservation devices, e.g., warm water tanks. Such power requirement represents a normal maximum electrical capacity as used for common household electrical appliances and wiring. Therefore, both water and power savings are achieved by the present device, resulting in increased simplicity and reduced overall size for the present device.

Although the invention is fully above explained as including specific applications and shapes, it should be understood that without the departing from the spirit and scope of the present invention, a variety of modifications and applications can be utilized and are contemplated.

What is claimed is:

1. A body part cleansing device adapted to be used with a toilet, said device comprising a nozzle comprising means for directing a jet of warm water and air for cleaning to a predetermined part of a user's body and an air intake unit adapted to introduce said air into said nozzle to be mixed with heated water within said nozzle, said nozzle further comprising an injector member and a nozzle member, said injector member and said nozzle member being detachably connected, said injector member having a throttle hole, and said nozzle member having a guide passage connected to said throttle hole, said air intake unit being connected to said guide passage.

2. A body part cleansing device in accordance with claim 1 wherein said nozzle is mounted substantially within an enclosing case, said nozzle including a joint connected to a warm water supply pipe, said pipe being attached to a water heating device, said injector member, said nozzle member, and said joint comprising independent elements which are detachably connected and thereby facilitate assembly and disassembly of said nozzle.

3. A body part cleaning device in accordance with claim 2 wherein said enclosing case includes a downwardly and outwardly extending nozzle cover unit adapted to cover said nozzle.

4. A body part cleansing device in accordance with claim 3 further comprising an electromagnetic valve, a flow adjustment valve, a water heating device, and a temperature controller which are positioned within said enclosing case.

5. A body part cleansing device in accordance with claim 4 further comprising an operation switch attached to an exterior portion of said enclosing case.

6. A body part cleansing device in accordance with claim 3 wherein said nozzle cover unit includes a cutout window, and wherein said nozzle member has a jet opening aligned with said cutout window to direct warm water and air outwardly at a predetermined angle and in a predetermined direction through said window.

7. A body part cleansing device in accordance with claim 6 wherein said device further comprises an auxiliary nozzle unit and an auxiliary water supply pipe.

8. A body part cleansing device in accordance with claim 7 wherein said auxiliary nozzle unit comprises an injector member with a throttle hole, a joint, and an auxiliary nozzle member having a turn passageway ending in a jet opening, said auxliary nozzle unit and said cleansing nozzle positioned adjacent to each other, said auxiliary nozzle unit jet opening and said cleansing nozzle member jet openings being positioned in substantially opposite directions.

9. A body part cleansing device in accordance with claim 8 wherein each of said injector members includes a large diameter portion, a step portion and a small diameter portion.

10. A body part cleansing device in accordance with claim 9 wherein the throttle hole of said auxiliary nozzle injection member has a diameter of a different size than the diameter of the throttle hole of said nozzle injector member, the small diameter portion of said auxiliary nozzle unit injector member and of said cleansing nozzle injector member being equal.

11. A body part cleansing device in accordance with claim 8 in combination with a toilet seat and a toilet lid, said toilet seat having a front and back portion, said nozzle jet opening being directed from the back towards the front of said toilet seat and said auxiliary nozzle unit jet opening being directed towards the back of said toilet seat.

12. A body part cleansing device in accordance with claim 2 wherein said injector member includes a small diameter portion adapted to fit within a through hole in said joint and a large diameter portion adapted to fit within a guide passageway of said nozzle member, said large and small diameter portions being separated by an intermediate step portion.

13. A body part cleansing device in accordance with claim 12 wherein said joint comprises a tubular joint body and a clamp plate, said clamp plate being attached to a top portion of said nozzle member by bolts inserted into clamp holes in said joint and in said nozzle member, said bolts being secured by nuts.

14. A body part cleansing device in accordance with claim 13 wherein said nozzle member is generally T-shaped and includes holder plates mounted by bolts and nuts onto a holder base, said holder base comprising a portion of a bottom plate of said casing.

15. A body part cleansing device in accordance with claim 1 wherein said air intake unit comprises an air intake passageway which is connected to said guide passageway of said nozzle member at an intermediate portion of said nozzle member, said air intake unit and passageway together comprising means for mixing said heated water with air bubbles to form the warm water which is jetted by said device.

* * * * *

UNITED STATES PATENT AND TRADEMARK OFFICE

CERTIFICATE OF CORRECTION

PATENT NO. : 4,389,738

DATED : June 28, 1983

INVENTOR(S) : Shizuka Ando; Hiroshi Oyama; Toshio Yamaguchi

It is certified that error appears in the above-identified patent and that said Letters Patent is hereby corrected as shown below:

On the first page, "Fukuoka" should read ---Fukuoka-ken---.

In the Abstract, line 5, "cleaning" should read ---cleansing---.

Column 2, line 43, delete "and".

Column 5, line 57, "havy" should read ---have---.

Column 6, lines 53-54, "aproximately" should read ---approximately---.

Column 8, line 26, delete "become" and insert ---be--- therefor;

line 47, "is fully above explained" should read -- is explained fully above---;

line 49, after "without" delete "the".

Signed and Sealed this

Twenty-fifth Day of September 1984

[SEAL]

Attest:

GERALD J. MOSSINGHOFF

Attesting Officer

Commissioner of Patents and Trademarks